United States Patent [19]

Benevenuta

[11] 4,235,463

[45] Nov. 25, 1980

[54] CLOSURE DEVICE FOR CONTAINER DOORS

[76] Inventor: Gianfranco Benevenuta, Fraz. Data 27, I-10084 Forno Canavese (Turin), Italy

[21] Appl. No.: 22,338

[22] Filed: Mar. 20, 1979

[30] Foreign Application Priority Data

Nov. 17, 1978 [IT] Italy ..... 69624 A/78

[51] Int. Cl.[3] ..... E05C 9/08

[52] U.S. Cl. ..... 292/218

[58] Field of Search ..... 292/218, DIG. 32, 342

[56] References Cited

U.S. PATENT DOCUMENTS

| | | | |
|---|---|---|---|
| 3,484,127 | 12/1969 | Pastva | 292/218 |
| 3,549,185 | 12/1970 | Lynn | 292/218 |
| 3,912,312 | 10/1975 | Cerutti | 292/218 |
| 4,087,122 | 5/1978 | Shaw et al. | 292/218 |

FOREIGN PATENT DOCUMENTS

| | | | |
|---|---|---|---|
| 1927476 | 5/1969 | Fed. Rep. of Germany | 292/218 |
| 2510554 | 10/1975 | Fed. Rep. of Germany | 292/218 |

*Primary Examiner*—Richard E. Moore

*Attorney, Agent, or Firm*—Young & Thompson

[57] ABSTRACT

A latch for maintaining in a closed condition doors hung by hinges on posts alongside access openings to containers such as packing cases and the like, and more especially of the kind with catches on the ends of upright rods mounted on the fronts of the doors remote from the hinges for axial rotation by operating handles affixed to the rods for engagement of the catches in and disengagement of the catches from keepers fixed to the cabinet casing in positions to be above and below the rods when the doors are closed, is characterized in that each keeper has two wedge-shaped projections whose tapered ends are adjacent and define between them a seating, and one of which has a double flange extending to the entry to said seating and providing a head, and each catch comprises a stem from which extend laterally two opposed pairs of projections shaped to define a wedge-shaped space between the two projections of each pair, each keeper and the catch associated therewith being so co-ordinated that when the latch is operatively mounted on a container having doors and the stem of the catch occupies the seating in the keeper, the two wedged-shaped projections of the keeper occupy substantially completely the spaces between the pairs of catch projections, and the catch projections of one pair are positively engaged below the head forming part of one of the keeper projections.

2 Claims, 10 Drawing Figures

CLOSURE DEVICE FOR CONTAINER DOORS

BACKGROUND OF THE INVENTION

The present invention relates to means for maintaining in a closed condition doors hung by hinges on posts alongside access openings to containers such as packing cases and the like, and more especially to means for the purpose aforesaid and of the kind with catches on the ends of upright rods mounted on the fronts of the doors remote from the hinges for axial rotation by operating handles affixed to the rods for engagement of the catches in and disengagement of the catches from keepers fixed to the cabinet casing in positions to be above and below the rods when the doors are closed.

Since the containers are subjected during transport to external forces in various directions and also to internal pressures from the load carrier therein, means of the kind stated must be capable of effective resistance to either direct or transverse forces, with maximum guarantee of not permitting accidental opening of the doors during transport.

Moreover, when the container doors are open, the container structure which is then less rigid, may undergo resilient deformations due to forces applied or to irregularities in the supporting plane, so that, on closing the container doors, the catches may be presented off-centre to the keepers fixed on the upper and lower bars of the fixed container structure. For satisfactory performance of the means of the kind stated, even in such abnormal conditions, there must be engagement between the catches and the keepers, and the subsequent closing operation must cause the catches and the keepers to co-operate with one another and restore the container to its original condition prior to the resilient deformations undergone thereby.

Means of the kind stated hitherto known with catches and keepers have not been able to satisfy these requirements fully, at least with the heavier stresses sometimes encountered. In particular the use of the catches and keepers may become impossible in the presence of major deformations, which may then have to be suitably compensated before closure can proceed. The successive stresses tend to cause loosening of the catches from the keepers and to transmit excessive stresses to the operating handles and to locking means for the latter; hence adequate stability in the means of the kind stated is not always ensured. Due to the inadequacies of known means of the kind stated, it has been necessary to provide for each door, in more heavily stressed containers, intermediate closure devices in addition to the means of the kind stated adjacent to the opening edges of the doors, further means of the kind stated nearer to the hinged edges of the doors. This increases the cost and complicates the opening and closing operations. In certain cases then, to achieve satisfactory results different means for the purpose aforesaid must be used intermediate the hinged edges of the doors and the means of the kind stated.

BRIEF SUMMARY OF THE INVENTION

The object of the present invention is to provide means for the purpose aforesaid and of the kind stated which can still be used even in the presence of considerable deformations in the container structure, the catches and keepers of which can compensate for such deformations, which is stable and reliable, reduces to a minimum the stresses transmitted to the operating handle, and is adapted to resist even the major foreseeable stresses, hence permitting the adoption of a single means of the kind stated, operable by a single handle, on the or each door even with containers intended for heavy loads.

In accordance with the invention I provide means for the purpose aforesaid and of the kind stated, wherein each keeper has two wedge-shaped projections whose tapered ends are adjacent and define between them a seating, and one of which has a double flange extending to the entry to said seating and providing a head, and each catch comprises a stem from which extend laterally two opposed pairs of projections shaped to define a wedge-shaped space between the two projections of each pair, each keeper and the catch associated therewith being so coordinated that when the means are operatively mounted on a container having doors and the stem of the catch occupies the seating in the keeper, the two wedge-shaped projections of the keeper occupy substantially completely the spaces between the pairs of catch projections, and the catch projections of one pair are positively engaged below the head-forming part of one of the keeper projections.

By giving the wedge-shaped projections of the keepers and the catches a large enough divergence, it is possible to ensure the keepers and the catches can engage each other correctly even when subject to considerable displacements from their theoretical relative positions, and the wedge shapes thus ensure recovery from such displacements during the closure operation. Once the closure is effected both parts of each catch are wedged in relation to the associated keeper, which makes their grip extremely stable. The engagement between a pair of catch projections and a keeper head may occupy a considerable area, and thus be capable of resisting large opening pressures exerted by the container contents; moreover, this engagement does not tend to relax as a result of small shifts, and may be retained by a light locking of the operating handle.

The internal surface of each keeper head preferably has a convexly curved profile, and the corresponding pair of catch projections are analogously curved and concave, which ensures steady progress during the closure operation, and once this is complete, greatly reduces the tendency of the fastening to open when subjected to a force.

The features described enable the closure device in accordance with the invention to satisfy simultaneously all the various demands on containers subjected to major stresses, demands which in most cases can be met by installing a single pair of closure devices connected by a single bar with a single operating handle, near the opening edge on each container door.

BRIEF DESCRIPTION OF THE DRAWINGS

An embodiment of the invention will now be described, by way of example, with reference to the accompanying drawings, wherein.

DETAILED DESCRIPTION OF A PREFERRED EMBODIMENT

Figure 1:
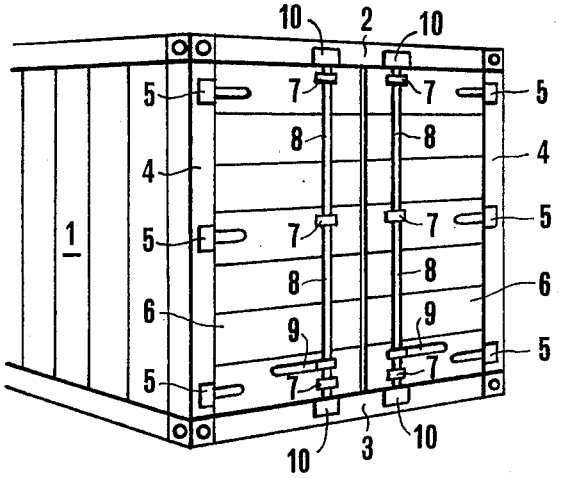
FIG. 1 shows schematically and in perspective one end of a container with doors and means of the kind stated for maintaining the doors in the closed condition.

At the end thereof shown in FIG. 1, the container has a structure comprising an upper bar 2, a lower bar 3 and two lateral posts 4. Two doors 6 are hung from the uprights by hinges 5. Near its hinge-remote edge each door 6 has a vertically-aligned series of collar-like supports 7 through which extends an upright rod 8 free to rotate about its axis. An operating handle 9 is fixed to each rod and is provided with locking means (not shown) for retention thereof in the position shown in FIG. 1 when the door is closed and latched. One each end of each rod 8 is secured a catch co-operable with the appropriate one of two keepers fixed on the upper and lower transverse bars 2 and 3 of the container to be immediately adjacent the catches when the door is closed. Each assembly of a keeper and a catch is shown at 10 in FIG. 1.

Figure 2:
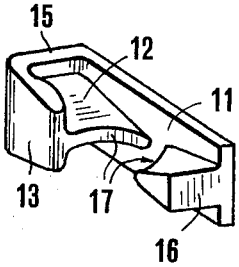
FIG. 2 shows in perspective a keeper of means of the kind stated in accordance with the invention.
Figure 3:
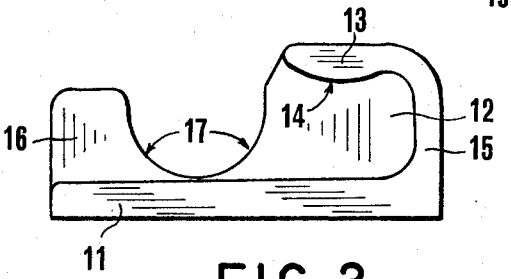
FIGS. 3 and 4 are respectively plan and elevational views of the keeper shown in FIG. 2.
Figure 4:
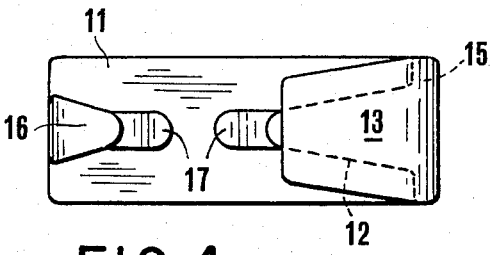

Each keeper (FIGS. 2 to 4) comprises a base 11 for fixing to the bar 2 or 3 and outstanding from which are two projections 12 and 16, each symmetrical about the plane bisecting the base 11 longitudinally. The projection 12 extends over about half the length of the base 11 and in section parallel to the base is of wedge-shape, as seen especially in FIG. 4. A double flange merging with the base 11 extends along the outer end edge and continues along the base-remote edge of the projections 12 to provide a strengthening end wall 15 and a head 13. The second projection 16 is similar to the projection 12 but is smaller in size, and in particular is also wedge-shaped. The tapered ends of the two projections 12 and 16 are directed towards each other and are bounded by curves which jointly define a substantially semi-circular seating 17 the axis of which is parallel to the base 11 and perpendicular to the aforesaid plane longitudinally bisecting the base 11. That surface 14 of the head 13 which faces towards the base 11 is convexly curved. The keeper just described is preferably a single metal forging.

Figure 5:
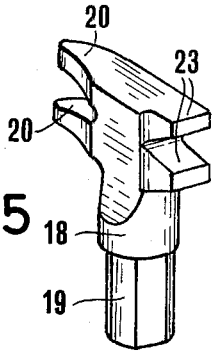
FIG. 5 shows in perspective a catch of means of the kind stated in accordance with the invention.
Figure 7:
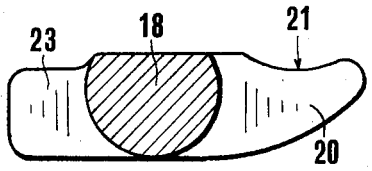
FIG. 7 shows a section through the catch on the line VII—VII in FIG. 6.
Figure 6:
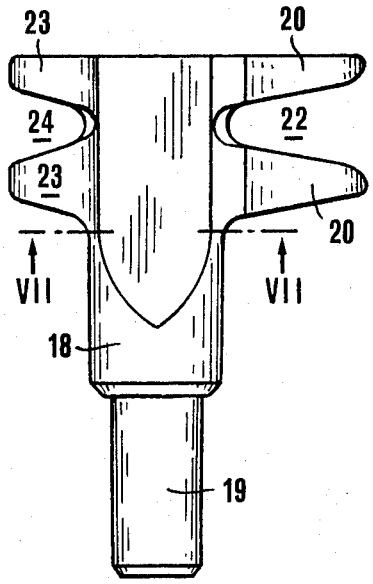
FIG. 6 is an elevational view of the catch of FIG. 5.
Figure 8:
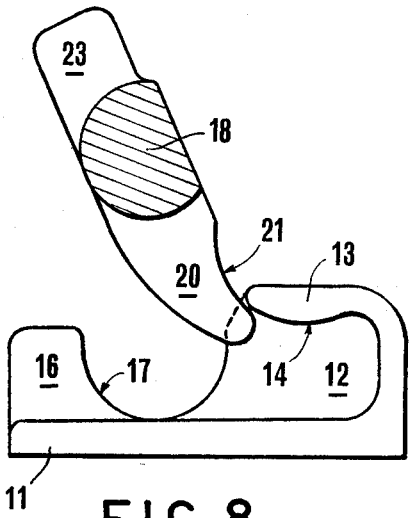
FIGS. 8 to 10 illustrate schematically a keeper and a catch co-operating therewith, at the start of engagement, at an advanced stage in the closing operation, and with closure completed.
Figure 9:
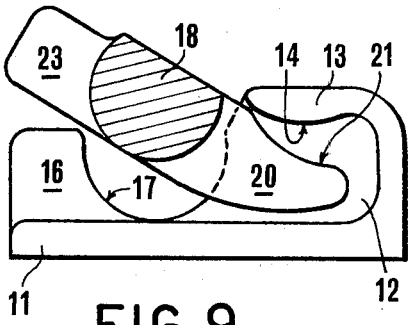
Figure 10:
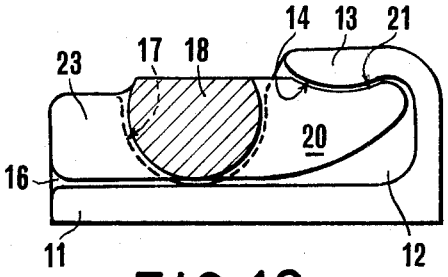

Each of the catches secured to the ends of the upright rods 8 (FIGS. 5 to 7) and thus rotatable under the control of operating handle 9, comprises a stem 18 which may be cylindrical or, as shown in FIGS. 8 to 10, have a segment removed therefrom to reduce its weight, a spigot 19 stepped down from stem 18 and intended to be secured in one of two sockets provided therefor in the ends of a rod 8, a first pair of projections 20 extending laterally from the stem 18 and defining between them a wedge-shaped space 22, corresponding in shape to the projection 12 outstanding from the keeper, and a second pair of projections 23 extending laterally from the stem 18 opposite in direction to the projections 20 and defining between them a wedge-shaped space 24 corresponding in shape to the second projection 16 outstanding from the keeper. One side surface 21 on each projection of the first pair 20 is concavely curved similarly to the convexly curved surface 14 of each keeper head 13. The catch just described is again preferably a single metal forging.

The means for the purpose aforesaid and of the kind stated, as described with reference to the drawings, operates as follows. When the doors 6 of container 1 are brought together, with the operating handles 9 in the opened state where they extend away from the doors, and these handles are then turned towards the closed state shown in FIG. 1 where they are hard against the doors, the rods 8 and with them the catches are turned about the axes of the rods 8 and the catches thus progressively engage with the keepers 11–17. As FIG. 8 shows, the first contact occurs between the tips of the first projections 20 extending from the catch stems 18, on the one hand, and the heads 13 of the projections 12 of the keepers, on the other hand. This engagement can effectively take place even if a keeper projection 12 is not centered between the catch projections 20 as it should theoretically be, since, because of the wedge-shape of the space 22 defined by these projections 20, the entry end of such engagement space 22 is much greater than the thickness at the leading end of the keeper projection 12, i.e. at the seating surface 17. Thus any accidental flexing of the container will not prevent engagement of the catches with the keepers.

On further turning of the operating handles 9 towards the closed state, the projections 20 pass below the heads 13, forcing the stems 18 of the catches closer to the semi-circular seatings 17 in the keeper (FIG. 9) and thus forcing the container doors to move towards the fully-closed position, against any resistance exerted by the container contents. At the same time the inclined surfaces of the projections 12 and 20, which enter into mutual engagement if the parts are not precisely centered, transmit a component of the closing force to the upper and lower bars 2 and 3 and to the container doors, hence tending to correct any accidental resilient deformations.

When the closing operation is finally concluded (FIG. 10), the cylindrical stem 18 of each catch is located in the semi-cylindrical seating 17 of the pertaining keeper; and two catch projections 23 are wedged on the keeper projection 16; and the two catch projections 20 are wedged on the keeper projection 12, with their concave surfaces 21 pressed against the convex internal surface 14 of the keeper head 13, providing an effective engagement which mutually blocks the parts in all directions and which can be released only by turning of the upright rods 8 about their axes. In this condition the doors 6 of the container 1 are firmly engaged to the transverse bars 2 and 3 and the lateral posts 4 and thus play an active part in the strength and rigidity of the container during transport operations.

Various modifications of a constructional nature may naturally be made in what has been described. The sections of the components may be selected in dependence on the forces foreseen, and the tapers of the corresponding wedge members in dependence on the deformations that may occur. The substantially cylindrical stem of the catches may have sections differing from a circular segment, and the semi-cylindrical seating in the catch may possibly correspond thereto over only part of its periphery. A strengthening end wall similar to the wall 15 may also be provided at the outer end of each keeper projection 16.

These and other modifications, and all replacements by technical equivalents, may be included in what has been described and illustrated by way of example, while remaining within the scope of the invention as defined in the following claims.

Having thus described my invention, what I claim is :

1. In a closure device for a container, comprising two lateral posts, an upper bar and a lower bar defining an access opening to the container, two doors closing said access opening, hinges connecting each door to one of said lateral posts, collar supports aligned along the edge of each door remote from said hinges, an upright rod rotatably mounted in said collar supports of each door, an operating handle connected to each said upright rod at a middle position thereof, a catch connected to each end of each said upright rods, and keepers mounted on said upper and lower bars in register with each said catches, the improvement that:

each said keeper has a flat base having a flat forward surface; a first and a second wedge-shaped projections from said base, said flat forward surface of said base being disposed equally on opposite sides of said projections; each said projection being tapered towards the other projection; a seating between said first and second projections defined by a part-cylindrical surface on each said projection substantially tangential to said flat forward surface of said base; and a double flange providing a head extending transversely from said first projection remote from said base; and each said catch comprises a stem having an at least partially cylindrical cross-section corresponding to said seating of each keeper; a first pair of projections from said stem; a first wedge-shaped space between the projections of said first pair, the cross-section of said first space corresponding to said first wedge-shaped projection of each keeper; a second pair of projections from said stem, substantially opposite said first pair of projections; and a second wedge-shaped space between the projections of said second pair, the cross-section of said second space corresponding to said second wedge-shaped projection of each keeper;

whereby in the closed condition of the container each stem of a catch occupies the seating of a keeper, the wedge-shaped projections of each keeper are wedged in the spaces between the projections of a catch, and the first pair of projections of each catch is positively engaged below the head of a keeper, said head of each keeper having an internal surface, facing the base of the keeper, said surface having a convexly-curved profile, and the projections of the first pair of projections of each catch having an external surface having a concavely-curved profile corresponding to the profile of the internal surface of the keeper head; said pairs of projections having edge surfaces that are substantially tangential to the cylindrical surface of the stem and substantially parallel to and closely adjacent said flat forward surface of the base in said closed condition of the container.

2. A closure device as set forth in claim 1, wherein each keeper has an end wall which extends transversely from said first projection and connects the end of said head, remote from said seating, to the corresponding end of the base of the keeper.

* * * * *

REEXAMINATION CERTIFICATE (286th)

United States Patent [19] [11] B1 4,235,463

Benevenuta [45] Certificate Issued Dec. 18, 1984

[54] CLOSURE DEVICE FOR CONTAINER DOORS

[76] Inventor: Gianfranco Benevenuta, Fraz. Data 27, I-10084 Forno Canavese (Turin), Italy

Reexamination Request:
No. 90/000,407, Jun. 21, 1983

Reexamination Certificate for:

| | |
|---|---|
| Patent No.: | **4,235,463** |
| Issued: | **Nov. 25, 1980** |
| Appl. No.: | **22,338** |
| Filed: | **Mar. 20, 1979** |

[30] Foreign Application Priority Data

Nov. 17, 1978 [IT] Italy ..... 69624 A/78

[51] Int. Cl.[3] ..... E05C 9/08
[52] U.S. Cl. ..... 292/218
[58] Field of Search ..... 292/213, 214, 217, 218, 292/DIG. 32

[56] References Cited

U.S. PATENT DOCUMENTS

| | | | |
|---|---|---|---|
| 3,212,805 | 10/1965 | Olander | 292/218 |
| 3,484,127 | 12/1969 | Pastva | 292/218 |
| 3,544,145 | 12/1970 | Cerutti | 292/54 |
| 3,549,185 | 12/1970 | Lynn | 292/218 |
| 3,661,412 | 5/1972 | Morris | 292/218 |
| 3,695,661 | 12/1972 | Pastva | 292/218 |
| 3,912,312 | 10/1975 | Cerutti | 292/218 |
| 4,087,122 | 5/1978 | Shaw et al. | 292/218 |

FOREIGN PATENT DOCUMENTS

| | | | |
|---|---|---|---|
| 1927476 | 12/1970 | Fed. Rep. of Germany | 292/218 |
| 2248356 | 4/1973 | Fed. Rep. of Germany | 292/218 |
| 2510554 | 10/1975 | Fed. Rep. of Germany | 292/218 |

OTHER PUBLICATIONS

SACA/Cerutti & C. Catalog, "Locks and Fittings for Containers and Jars, 1976, 26 pp.

*Primary Examiner*—Thomas J. Holko

[57] ABSTRACT

A latch for maintaining in a closed condition doors hung by hinges on posts alongside access openings to containers such as packing cases and the like, and more especially of the kind with catches on the ends of upright rods mounted on the fronts of the doors remote from the hinges for axial rotation by operating handles affixed to the rods for engagement of the catches in and disengagement of the catches from keepers fixed to the cabinet casing in positions to be above and below the rods when the doors are closed, is characterized in that each keeper has two wedge-shaped projections whose tapered ends are adjacent and define between them a seating, and one of which has a double flange extending to the entry to said seating and providing a head, and each catch comprises a stem from which extend laterally two opposed pairs of projections shaped to define a wedge-shaped space between the two projections of each pair, each keeper and the catch associated therewith being so co-ordinated that when the latch is operatively mounted on a container having doors and the stem of the catch occupies the seating in the keeper, the two wedged-shaped projections of the keeper occupy substantially completely the spaced between the pairs of catch projections, and the catch projections of one pair are positively engaged below the head forming part of one of the keeper projections.

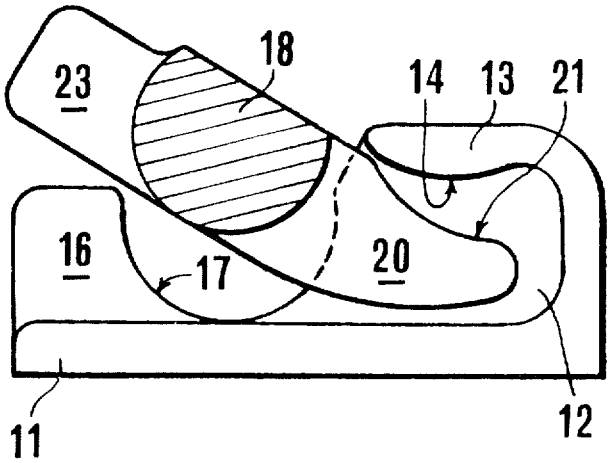

REEXAMINATION CERTIFICATE ISSUED UNDER 35 U.S.C. 307.

THE PATENT IS HEREBY AMENDED AS INDICATED BELOW.

AS A RESULT OF REEXAMINATION, IT HAS BEEN DETERMINED THAT:

Claims 1 and 2 are cancelled.

* * * * *